US005156124A

United States Patent [19]

Sugimoto et al.

[11] Patent Number: 5,156,124

[45] Date of Patent: Oct. 20, 1992

[54] FUEL INJECTION STRUCTURE FOR AN INTERNAL COMBUSTION ENGINE

[75] Inventors: Tomojiro Sugimoto, Susono; Keiso . Takeda, Mishima; Takashi Izuo; Toshiaki Yamamoto, both of Toyota, all of Japan

[73] Assignee: Toyota Jidosha Kabushiki Kaisha, Toyota, Japan

[21] Appl. No.: 667,954

[22] Filed: Mar. 12, 1991

[30] Foreign Application Priority Data

Mar. 15, 1990 [JP] Japan ..... 2-25040[U]

[51] Int. Cl.[5] ..... F02B 3/00

[52] U.S. Cl. ..... 123/302; 123/432; 123/52 M; 123/470

[58] Field of Search ..... 123/302, 432, 52 M, 123/470, 472, 531

[56] References Cited

U.S. PATENT DOCUMENTS

| | | | |
|---|---|---|---|
| 4,341,193 | 7/1982 | Bowler | 123/472 |
| 4,416,238 | 11/1983 | Knapp et al. | 123/470 |
| 4,436,071 | 3/1984 | Hafner et al. | 123/472 |
| 4,726,340 | 2/1988 | Hasegawa et al. | 123/432 |
| 4,753,205 | 6/1988 | Knapp et al. | 123/472 |
| 4,773,374 | 9/1988 | Kiuchi et al. | 123/470 |
| 4,877,004 | 10/1989 | Nishizawa | 123/432 |
| 4,932,378 | 6/1990 | Hitomi et al. | 123/432 |
| 4,938,191 | 7/1990 | Oldani et al. | 123/432 |
| 4,945,877 | 8/1990 | Ziegler et al. | 123/472 |
| 4,982,716 | 1/1991 | Takeda et al. | 123/470 |

FOREIGN PATENT DOCUMENTS

| | | | |
|---|---|---|---|
| 0043958 | 3/1984 | Japan | 123/470 |
| 0074369 | 4/1984 | Japan | 123/470 |
| 0003477 | 1/1985 | Japan | 123/470 |
| 0045774 | 3/1985 | Japan | 123/470 |

*Primary Examiner*—David A. Okonsky
*Attorney, Agent, or Firm*—Kenyon & Kenyon

[57] ABSTRACT

A fuel injection structure for an internal combustion engine includes a straight intake port defining passage formed in an intake passage of the engine and a fuel injection valve disposed within a passage-defining wall which defines the straight intake port defining passage therein. The fuel injection valve is arranged inside the intake passage in parallel with a passage axis of the straight intake port defining passage in an elevational view of the engine. The fuel is injected from the fuel injection valve and flows in parallel with the intake air flow. Due to the parallel flow of the fuel and the intake air, the injected fuel does not tend to adhere to the wall surface of the intake port defining passage. This parallel flow is not affected by a change in the speed of the intake air flow.

17 Claims, 5 Drawing Sheets

FUEL INJECTION STRUCTURE FOR AN INTERNAL COMBUSTION ENGINE

BACKGROUND OF THE INVENTION

1. Field of the Invention

The present invention relates to a fuel injection structure for an internal combustion engine with a straight intake port defining passage.

2. Description of the Prior Art

An internal combustion engine with a straight intake port defining passage which extends straight in an oblique and upward direction from the vicinity of a valve head of an intake "valve so as to define an intake port at a downstream end of the intake port defining passage is disclosed in, for example, Japanese Patent Publication 62-28368. As illustrated in FIG. 10 (Prior Art), a fuel injection valve is mounted to such a straight intake port defining passage with an angle $\theta_1$ defined between an axis of the straight intake defining passage port 2 and an axis of the fuel injection valve 4. In the arrangement, fuel is injected with angle $\theta_1$ with respect to the direction of the intake air flow.

However, there are the following problems in the above-described fuel injection. First, a great amount of fuel collides with and adheres to a bottom surface of the intake port defining passage and the response characteristic of the engine is degraded. Secondly, in accordance with changes in the load or in the flow velocity of the intake air, the direction of the injected fuel changes upward and downward (in direction x of FIG. 10), and an optimum direction of the fuel injection cannot be determined. This means that the fuel is injected in non-optimum directions in almost all operating conditions.

SUMMARY OF THE INVENTION

An object of the present invention is to provide a fuel injection structure for an internal, combustion engine with a straight intake port defining passage wherein fuel is injected into the straight intake port defining passage in parallel with an axis of the straight intake port defining passage so that the above-discussed problems of the prior art can be solved.

This object can be attained by a fuel injection structure for an internal combustion engine in accordance with the present invention by providing an intake port having a straight central axis in elevation (that is, a straight axis in an elevational view of the port) in an intake passage of the engine and a fuel injection valve disposed in the straight intake port defining passage so that a valve axis of the fuel injection valve is parallel to the straight central axis of the intake port defining passage.

In this fuel injection structure, since, the injection valve axis is parallel to the intake part defining passage axis, the injected fuel flows in the intake port defining passage is in parallel with the intake air flow so that adhering of the injected fuel to the wall surface of the intake port defining passage is minimized and the response characteristic of the engine is improved.

BRIEF DESCRIPTION OF THE DRAWINGS

The above described object and other objects, features, and advantages of the present invention will become apparent and will be more readily appreciated from the following detailed description of the preferred embodiments of the invention taken in conjunction with the accompanying drawings, in which.

DETAILED DESCRIPTION OF THE PREFERRED EMBODIMENTS

Figure 1:
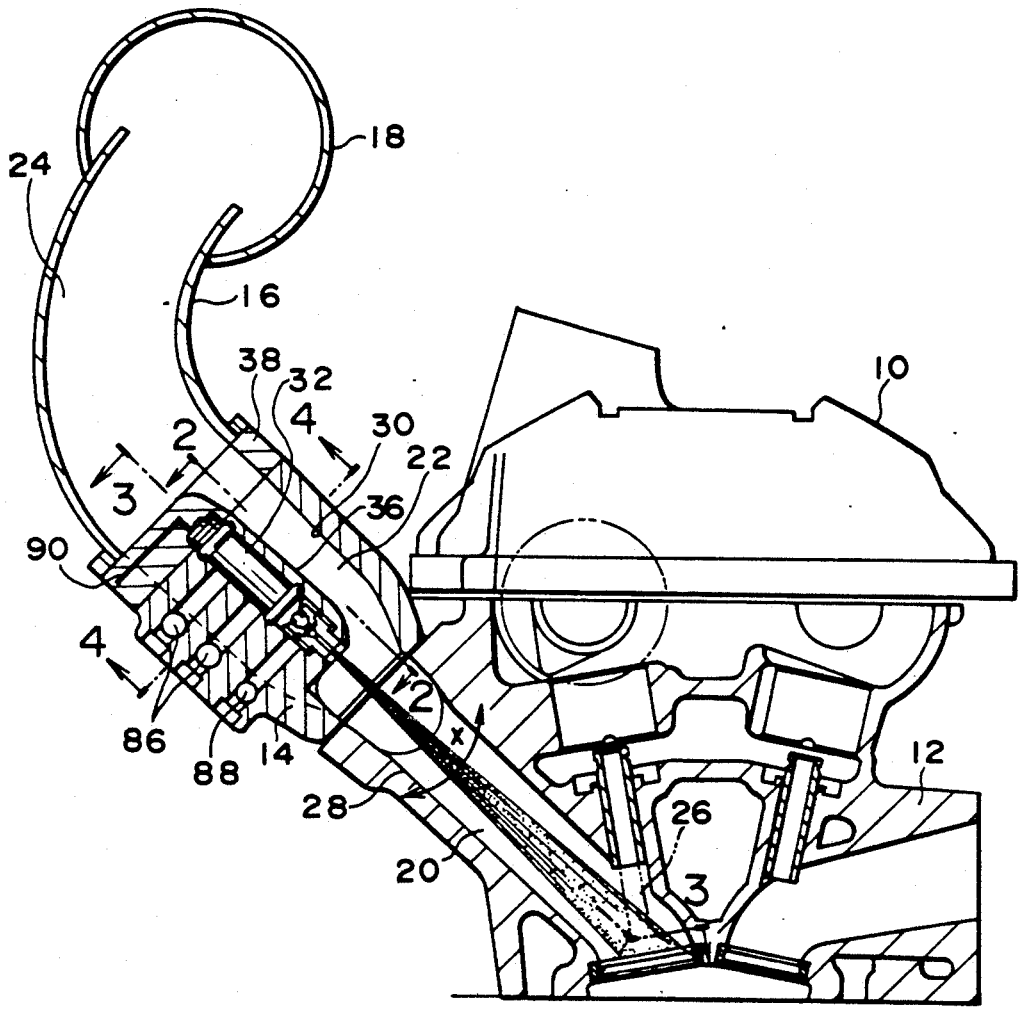
FIG. 1 is an end elevational view in cross section of a fuel injection structure for an internal combustion engine in accordance with a first embodiment of the invention.

First, a fuel injection structure for an internal combustion engine in accordance with a first embodiment of the invention will be explained with reference to FIGS. 1 to 5. As illustrated in FIG. 1, an air intake member 14 is coupled to a cylinder head 12 of an internal combustion engine 10, and an intake pipe 16 is coupled to the air intake member 14 to connect the air intake member 14 with a surge tank 18.

Figure 3:
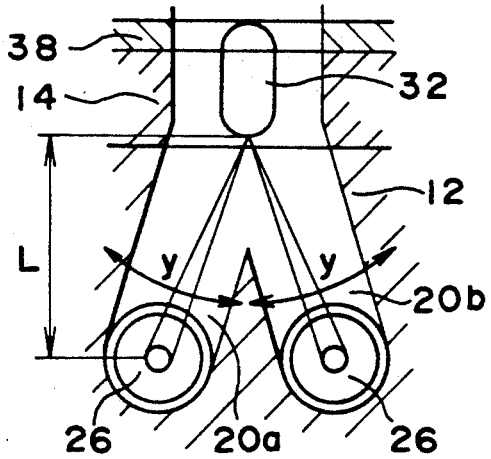
FIG. 3 is a cross-sectional view of a first intake portion of the structure of FIG. 1 as viewed in a direction of arrows 3—3 in FIG. 1.

An intake passage 24 includes a first intake portion 20 formed in the cylinder head 12, a second intake portion 22 formed in the air intake member 14 and connected with the first intake portion 20, and a passage formed in the intake pipe 16. As illustrated in FIG. 1, the first intake portion 20 and the second intake portion 22 are straight in the elevational thereof and extend from the vicinity of a valve head of an intake valve 26 in an oblique and upward direction to constitute a so-called straight intake port defining passage 28 which defines an intake port at a downstream end of the intake port defining passage. The intake port defining passage may not be straight in the plan view thereof. More particularly, as illustrated in FIG. 3, the intake port defining passage 28 the first embodiment is bent at an intermediate portion thereof in the plan view and is divided into two branch ports 20*a* and 20*b*. The intake valves 26 are located at downstream ends of the branch ports 20*a* and 20*b*.

Figure 2:
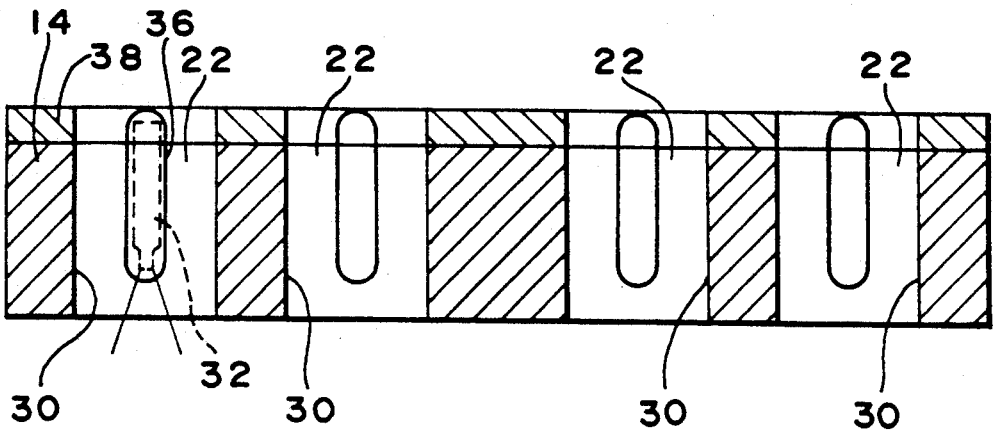
FIG. 2 is a cross-sectional view of an air intake member of the structure of FIG. 1 as viewed in the direction of arrows 2—2 in FIG. 1.

As illustrated in FIG. 2, in the case of a multi-cylinder internal combustion engine, the air intake member 14 has a single body in which a plurality of second intake portions 22 are formed. The second intake portions 22 are independent of each other. Each straight intake port defining passage 28 is defined by a passage-defining wall 30 and has a passage axis.

Figure 4:
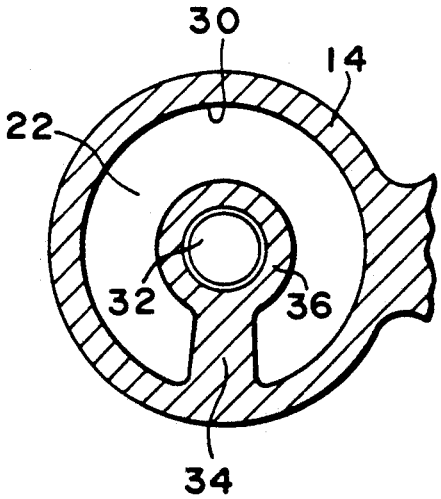
FIG. 4 is a cross-sectional view of a portion of the structure of FIG. 1 taken in a direction of arrows 4—4 in FIG. 1.

A fuel injection valve 32 is disposed in the second intake portion 22 of each straight intake port defining passage 28. The fuel injection valve 32 is disposed within the passage-defining wall 30 and is directed so that a valve axis of the fuel injection valve 32 is parallel to the passage axis of the straight intake port defining passage 28. As illustrated in FIG. 4, an arm 34 protrudes into the second intake portion 22 from the passage-defining wall 30, and a cylindrical jacket 36 is integrally formed with and supported by the arm 34. The jacket 36 extends in the axial direction of the second intake portion 22 at a radially central portion of the second intake portion 22. The fuel injection valve 32 is inserted into the cylindrical jacket 36 and is secured by a cap 38 which is coupled to the jacket 36. As illustrated in FIG. 4, an outside surface of the jacket 36 and an inside surface of the air intake member 14 define a passage with a substantially annular cross-section which is interrupted by the arm 34.

Figure 5:
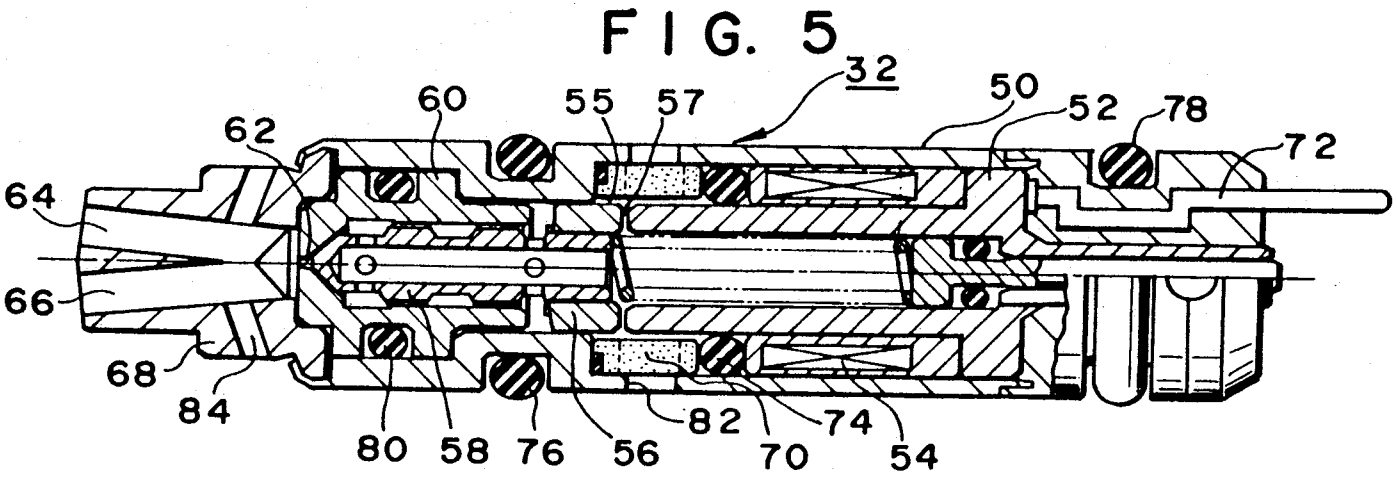
FIG. 5 is a cross-sectional view of a fuel injection valve used in the first embodiment of the invention.

As illustrated in FIG. 5, the fuel injection valve includes a housing 50, a fixed core 52 fixed to the housing 50, a solenoid coil 54 wound around the fixed core 52, a movable core 56 movable relative to the fixed core 52 and attracted to the fixed core 52 when an electric current flows through the solenoid coil 54, a needle 58 coupled to the movable core 56 so as to move together with the movable core 56, a valve seat member 60 fixed to the housing 50 and having a valve seat and a fuel metering hole 62, an adapter 68 having two injected fuel paths 64 and 66 through which the fuel injected from the fuel metering hole 62 flows, a strainer 70 for filtering the fuel, a connector 72 for supplying electricity to the coil 54, and seal rings 74, 76, 78 and 80. A fuel supply hole 82 is formed in the housing 50 and an assist air supply hole 84 is formed in the adapter 68.

The fuel supply hole 82 is provided at a side portion of an axially intermediate portion of the fuel injection valve 32 so that the length of the fuel injection valve is shortened as compared with a conventional fuel injection valve in which a fuel supply hole is formed in a longitudinal end portion of the valve. Also, the connector 72 is adapted so as to extend in the axial direction of the fuel injection valve 32 so that the size of the fuel injection valve 32 in the direction perpendicular to the valve axis is made compact as compared with the conventional fuel injection valve in which a connector is provided obliquely with respect to the valve axis. Due to this small size, the fuel injection valve 32 can be disposed within the passage-defining wall 30 of the second intake portion 22.

As illustrated in FIG. 3, injected fuel paths 64 and 66 are directed toward two branch passages 20*a* and 20*b*, respectively, of the first intake portion 20 so that the fuel sprays injected into the respective branch passages flow toward the respective valve heads of the intake valves 26.

As illustrated in FIG. 1, supply and return fuel passages 86 are formed in the arm 34 and the jacket 36. Also, an assist air passage 88 for leading air to the assist air introduction holes 84 formed in the adapter 68 is formed in the arm 34 and the jacket 36. Further, an electricity supply lead 90 is provided in the cap 38 for supplying electricity to the connector 72.

Operation of the first embodiment will now be explained.

The intake air flows through the surge tank 18, the intake pipe 16 and the air intake member 14 to the first intake portion 20 formed in the cylinder head, where the intake air is divided to flow into the branch ports 20*a* and 20*b* and finally into a combustion chamber through clearances between the intake valves 26 and the valve seats. The fuel is injected into the intake air at the air intake member 14. The direction of the fuel injection is in parallel with the axis of the straight intake port defining passage 28 and therefore with the direction of the intake air flow in the elevational view as shown in FIG. 1. In the plan view, as shown in FIG. 3, the directions of the fuel sprays injected from the injected fuel paths 64 and 66 are in parallel with the axes of the branch passages 20*a* and 20*b* of the first intake portion 20.

Figure 10:
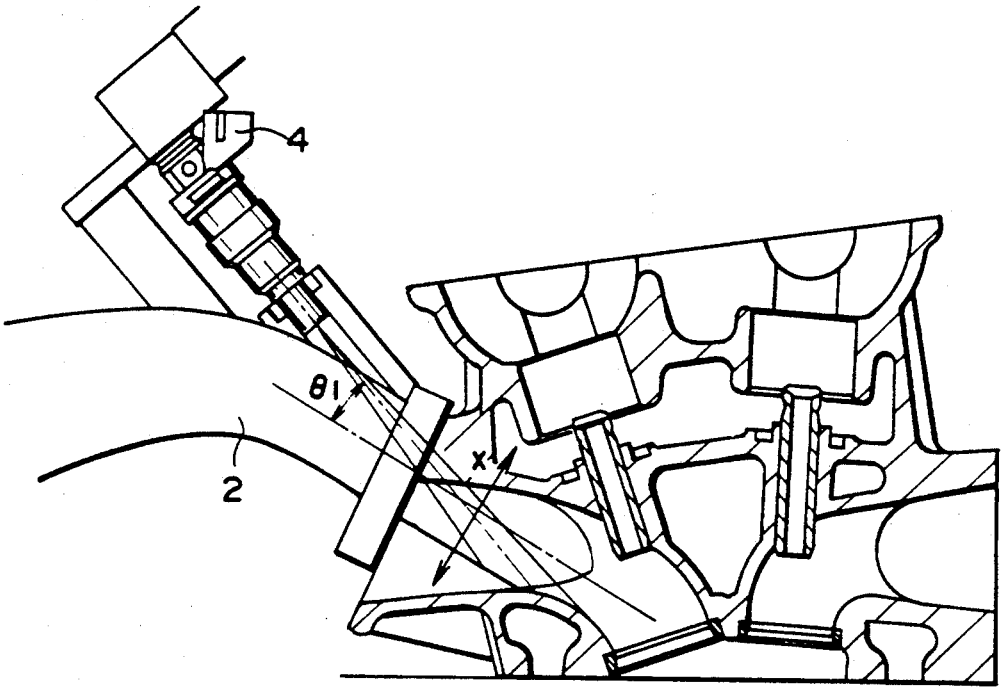
FIG. 10 (PRIOR ART)
FIG. 10 is a cross-sectional end elevational view of a prior art fuel injection structure for an internal combustion engine with a straight intake port.

Due to the fuel injection in parallel with the port axis in the elevational view, adhering of the injected fuel to the lower surface of the passage defining wall 30 is suppressed. If fuel were injected obliquely with respect to the axis of the passage 20 as shown in FIG. 10 (Prior Art), the injected fuel would collide with and adhere to the wall surfaces. Further, due to the fuel injection in parallel with the passage axis in the elevational view, even if the speed of the intake air flowing in the straight intake port defining passage 28 changes, the direction of flow of the injected fuel does not change in the vertical direction (in the direction x of FIG. 1) in the elevational view, so the fuel does not tend to adhere to either the upper surface or the lower surface of the passage defining wall.

Further, since the fuel injection valve 32 is installed within the passage defining wall 30, the intake air flows around the injected fuel to envelop the fuel and prevents the injected fuel from contacting the passage defining wall 30. Furthermore, due to the arrangement of the fuel injection valve 32 within the passage-defining wall 30, freedom of arrangement of the fuel injection valve 32 increases so that the fuel injection valve 32 can be located closer to the intake valve 26, more particularly, adjacent to the junction of the branches 20*a* and 20*b*. As a result, fuel transportation distance L (see FIG. 3) is shortened, and the response characteristic of the engine is improved.

The arrangement of the fuel injection valve 32 within the passage-defining wall 30 causes the further advantages described below.

First, noises which the fuel injection valve 32 generates in operation are prevented from leaking outside so that the engine noise is suppressed.

Second, the fuel injection valve 32 is well cooled by the intake air flow so that the temperature of the fuel tank is lowered by the cooled return fuel and generation of fuel vapor is suppressed.

Third, since the distance between the fuel injection valve 32 and the intake valve 26 can be shortened, change in directions of the injected fuel in the plan view in accordance with change of the speed of flow of the intake air (that is, the change of the direction of flow of the injected fuel in the direction y of FIG. 3) is also suppressed so that adhering of the injected fuel to the side walls of the passage is suppressed to improve the response characteristic of the engine.

Fourth, since the direction of the fuel injection in the plan view is stabilized, the distance between the fuel metering hole 62 and the exit side ends of the injected fuel paths 64 and 66 can be further shortened. As a result, the dead volume between the fuel metering hole 62 and the exit ends of the injected fuel paths 64 and 66 is reduced. Therefore, the time delay between operation of the needle 58 and fuel injection from the injected fuel paths 64 and 66 is reduced so that the response characteristic and the starting characteristic of the fuel injection structure are further improved.

The fuel injection valve 32 can take various modifications as shown in FIGS. 6, 7, 8, and 9 which correspond to fuel injection valves used in a second, a third, a fourth, and a fifth embodiment of the invention, respectively. Throughout all the embodiments including the first embodiment, like members are denoted with like reference numerals.

Figure 6:
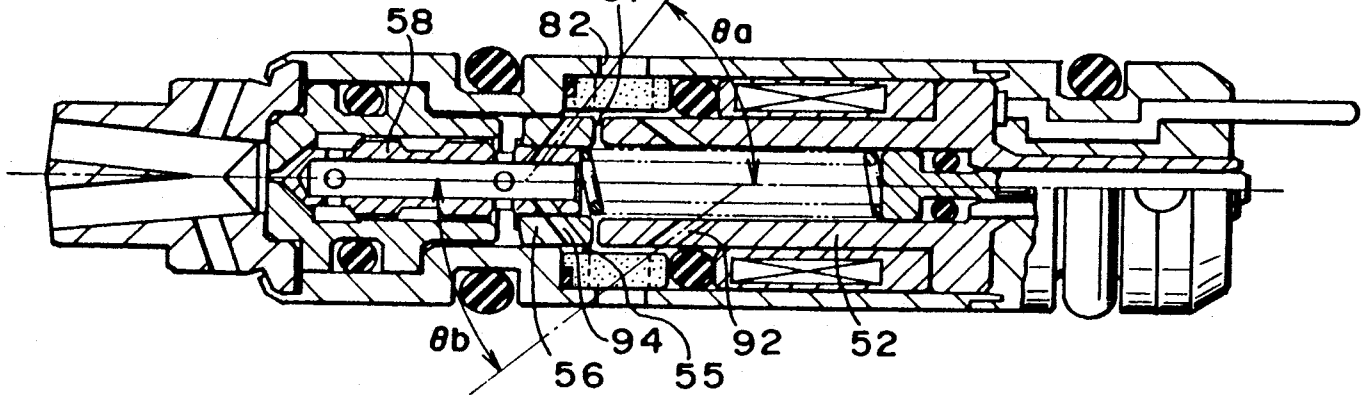
FIG. 6 is a cross-sectional view of a fuel injection valve used in a second embodiment of the invention.

In the fuel injection valve in accordance with the second embodiment of the invention, as illustrated in FIG. 6, penetration holes 92 and 94 are formed in the fixed core 52 and the movable core 55, respectively, in the vicinity of the fuel supply hole 82. The penetration holes 92 and 94 obliquely penetrate the fixed core 52 and the movable core 56 with angles $\theta_a$ and $\theta_b$, respectively, so that ends of the holes 92 and 94 positioned at the outside surfaces of the cores 52 and 56 are located adjacent to the fuel supply hole 82 in the axial direction of the fuel injection valve and other ends of the holes 92 and 94 positioned at the inside surfaces of the cores 52 and 56 are located far from the fuel supply hole 82 in the axial direction of the fuel injection valve. The penetration hole 94 which penetrates the movable core 56 further extends through a wall of the needle 58 to open to a center hole of the needle 58.

Operation of the second embodiment will be explained. In the fuel injection valve in accordance with the first embodiment (see FIG. 5), the fuel which has passed through the strainer 70 flows through a clearance 55 defined between the movable core 56 and the housing 50 and a clearance 57 defined between the fixed core 52 and the movable core 56 and fills the spaces defined within the fixed core 52, the needle 58 and the valve seat member 60 to finally flow to the fuel metering hole 62. However, since the clearance defined between the movable core 56 and the fixed core 52 is small and the clearance defined between the movable core 56 and the housing 50 has to be small for generating a sufficient magnetic flux path therethrough, the flow resistance of the fuel flowing through these clearances is high, causing the fuel pressure to fluctuate and making operation of the needle 58 unstable.

However, since the penetration holes 92 and 94 are formed in the fuel injection valve of the second embodiment, the fuel which has passed through the strainer 70 can flow smoothly through the holes 92 and 94 to the fuel metering hole 62. Therefore, in the second embodiment, the flow resistance inside the fuel injection valve 32 is reduced and the fuel injection is stabilized. Further, since the penetration hole 92 formed in the fixed core 52 is inclined by angle $\theta_b$ with respect to the fuel injection valve, air bubbles can escape together with the fuel flow even if such air bubbles are generated in the fixed core 52. Therefore, deterioration of the starting characteristic and instability of fuel pressure which would occur due to air bubbles in the conventional fuel injection valve would be prevented. Further, since the penetration hole 94 formed in the movable core 56 and the needle 58 is inclined by angle by $\theta_a$ with respect to the axis of the fuel injection valve, the fuel can flow in the direction to escape an increase in the fuel pressure which will occur when the needle 58 moves in the direction to close the fuel metering hole, and also the fuel can flow in the direction to suppress a decrease in the fuel pressure which will occur when the needle 58 moves in the direction to open the fuel metering hole.

Figure 7:
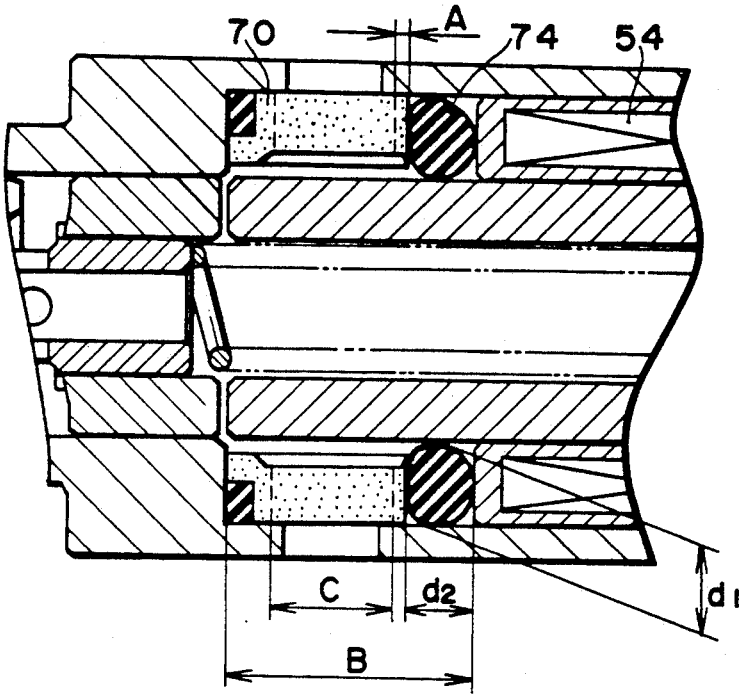
FIG. 7 is a partial, cross-sectional view of a fuel injection valve used in a third embodiment of the invention.

In the fuel injection valve in accordance with the third embodiment of the invention, as illustrated in FIG. 7, a distance A between a solenoid coil end of the strainer 70 and a fuel passing portion C of the strainer 70 is decreased as compared with the first embodiment. Further, a diameter $d_1$ (a diameter in the radial direction of the fuel injection valve) of the cross-section of the seal ring 74 (O-ring) is made greater than a diameter $d_2$ (a diameter in the axial direction of the fuel injection valve) of the cross-section of the seal ring 74 in a free state of the seal ring.

Figure 8:
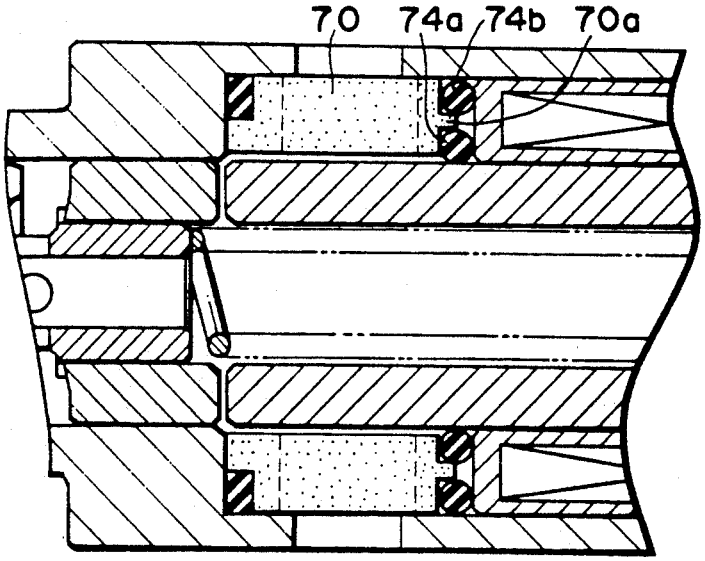
FIG. 8 is a partial, cross-sectional view of a fuel injection valve used in a fourth embodiment of the invention.

Further, in the fuel injection valve in accordance with the fourth embodiment of the invention, as illustrated in FIG. 8, a protrusion **70*a* is integrally formed on a solenoid coil end of the strainer 70 so as to protrude toward the solenoid coil 54. Seal rings 74*a* and 74*b* are disposed radially inside and outside the protrusion 70*a***, respectively.

Figure 9:
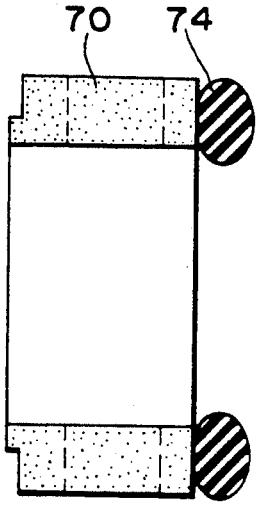
FIG. 9 is a cross-sectional view of a strainer and O-ring seal for a fuel injection valve used in a fifth embodiment of the invention.

Further, in the fuel injection valve in accordance with the fifth embodiment of the invention, as illustrated in FIG. 9, the seal ring 74 is bonded to the axial end surface of the strainer 70 by, for example, a binder.

Operation of the third to fifth embodiments of the invention will now be explained. Though the seal ring 74 which is disposed between the solenoid coil 54 and the strainer 70 has a circular cross-section in the free state thereof in the first embodiment (that is, $d_1 = d_2$), the compression rate in the axial direction of the fuel injection valve is great when the seal ring 74 is axially squeezed between the coil 54 and the strainer 70 to cause a necessary radial sealing forces. As a result, the durability of the strainer 70 may be decreased if large vibratory loads act on the seal ring 74. However, owing to any structure of the third to fifth embodiments, the compression rate of the seal ring 74 in the axial direction of the fuel injection valve is decreased as compared with the first embodiment and the durability of seal ring 74 is improved. Further, the axial distance B of the combination of the strainer 70 and the seal ring 74 is shortened so that the area of magnetic flux formation surface can be increased. Furthermore, since the length C of the fuel passing portion of the strainer 70 need not be shortened, a sufficient fuel path area is obtained.

In accordance with the present invention, the following advantages are obtained. Since a straight intake port defining passage is formed in the intake passage and a fuel injection valve is installed within a passage-defining wall which defines the straight intake port defining passage therein, the fuel injected from the fuel injection valve flows in parallel with the intake air flow and with the injected fuel surrounded by the intake air flow, so that adhering of the injected fuel to the surface of the passage defining wall is prevented and the response characteristic of the engine is improved.

Although only several embodiments of the invention have been described in detail above, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A fuel injection structure for an internal combustion engine comprising:

an intake port defining passage that is straight in an elevation plane and is formed in a portion of an intake passage of the engine downstream of a surge tank so as to define an intake port at a downstream end of the intake port defining passage, the intake port defining passage extending in an oblique and upward direction from the vicinity of a valve head of an intake valve and having a passage-defining wall and a passage axis; and a fuel injection valve having a valve axis and being disposed within the passage-defining wall of the intake port defining passage so that the valve axis is parallel to the passage axis of the intake port defining passage.

2. A fuel injection structure for an internal combustion engine according to claim 1, wherein the intake passage includes a first intake portion formed in a cylinder head of the engine, a second intake portion formed in an air intake member coupled to the cylinder head, and an intake pipe coupled to the air intake member, the first intake portion and the second intake portion together constituting the intake port defining passage.

3. A fuel injection structure for an internal combustion engine according to claim 2, wherein the first intake portion is divided into two branch ports, and intake valves are disposed at downstream ends of the branch ports.

4. A fuel injection structure for an internal combustion engine according to claim 2, wherein the fuel injection valve is disposed in the second intake portion.

5. A fuel injection member for an internal combustion engine according to claim 2, wherein the air intake member includes an arm protruding into the second intake port, a jacket located in the second intake portion and supported by the arm, and a cap coupled to the jacket, the fuel injection valve being supported by the jacket.

6. A fuel injection member for an internal combustion engine according to claim 5, wherein an outside surface of the jacket and an inside surface of the air intake member define a passage of a substantially annular cross-section for intake air to flow therethrough.

7. A fuel injection structure for an internal combustion engine according to claim 1, wherein the fuel injection valve comprises:

a housing having a fuel supply hole formed therein;

a fixed core fixed to the housing;

a solenoid coil wound around the fixed core;

a strainer surrounding the fixed core and disposed between the fuel supply hole in the housing and the solenoid coil;

a seal ring provided between the strainer and the solenoid coil;

a movable core movable relative to the fixed core;

a connector connected to the solenoid coil for supplying electricity to the solenoid coil;

a needle coupled to the movable core and movable together with the movable core;

a valve seat member fixed to the housing, a valve seat being defined on the valve seat member, the needle moving to and from the valve seat;

fuel metering hole means formed in the valve seat member; and an adapter coupled to the housing and having at least one injected fuel path formed therein and at least one assist air injection hole formed therein.

8. A fuel injection structure for an internal combustion engine according to claim 7, wherein the fuel supply hole is formed in a side portion of the fuel injection valve housing.

9. A fuel injection structure for an internal combustion engine according to claim 7, wherein the connector extends in an axial direction of the fuel injection valve.

10. A fuel injection structure for an internal combustion engine according to claim 5, wherein a fuel supply passage for supplying fuel to the fuel injection valve and an assist air supply passage for supplying assist air to the fuel injection valve are formed in the arm and the jacket.

11. A fuel injection structure for an internal combustion engine according to claim 5, wherein an electricity supply lead for supplying electricity to the fuel injection valve is provided in the cap.

12. A fuel injection structure for an internal combustion engine according to claim 7, wherein the adapter of the fuel injection valve has two injected fuel paths formed therein which are directed toward respective valve heads of two intake valves.

13. A fuel injection structure for an internal combustion engine according to claim 7, wherein a first penetration hole is formed in the fixed core and a second penetration hole is formed in the movable core so that an end of the first penetration hole positioned at an outside surface of the fixed core and an end of the second penetration hole positioned at an outside surfaces of the movable core are adjacent to the fuel supply hole in an axial direction of the fuel injection valve and another end of the first penetration hole positioned at an inside surface of the fixed core and another end of the second penetration hole positioned at an inside surfaces of the movable core are far from the fuel supply hole in an axial direction of the fuel injection valve.

14. A fuel injection structure for an internal combustion engine according to claim 13, wherein the second penetration hole further extends through a wall of the needle to open to a space defined within the needle.

15. A fuel injection structure for an internal combustion engine according to claim 7, wherein the seal ring provided between the strainer and the solenoid coil has a cross-section having a first diameter extending in a radial direction of the fuel injection valve and a second diameter extending in an axial direction of the fuel injection valve, the first diameter being selected greater than the second diameter.

16. A fuel injection structure for an internal combustion engine according to claim 7, wherein the strainer includes a projection which protrudes from an end surface of the strainer toward the solenoid coil and wherein O-rings which constitute the seal ring are provided radially outside and inside the projection.

17. A fuel injection structure for an internal combustion engine according to claim 7, wherein the strainer and the seal ring are bonded to each other.

* * * * *